US008777481B2

(12) United States Patent
Conus et al.

(10) Patent No.: US 8,777,481 B2
(45) Date of Patent: Jul. 15, 2014

(54) SHOCK ABSORBER BEARING FOR A ROTATING WHEEL SET OF A TIMEPIECE MOVEMENT

(75) Inventors: Thierry Conus, Lengnau (CH); Jean-Jacques Born, Morges (CH)

(73) Assignee: The Swatch Group Research and Development Ltd, Marin (CH)

( * ) Notice: Subject to any disclaimer, the term of this patent is extended or adjusted under 35 U.S.C. 154(b) by 138 days.

(21) Appl. No.: 13/330,862

(22) Filed: Dec. 20, 2011

(65) Prior Publication Data

US 2012/0155231 A1 Jun. 21, 2012

(30) Foreign Application Priority Data

Dec. 21, 2010 (EP) ..... 10196103

(51) Int. Cl.
*G04B 31/04* (2006.01)

(52) U.S. Cl.
USPC ..... 368/324; 368/326

(58) Field of Classification Search
USPC ..... 368/324–326; 384/125, 215
See application file for complete search history.

(56) References Cited

U.S. PATENT DOCUMENTS

| | | | | |
|---|---|---|---|---|
| 2,282,122 | A * | 5/1942 | Erismann | 368/326 |
| 2,543,328 | A * | 2/1951 | Morf | 368/326 |
| 2,621,469 | A * | 12/1952 | Erismann | 368/326 |
| 2,938,328 | A * | 5/1960 | Derr et al. | 368/326 |
| 3,278,245 | A * | 10/1966 | Matthey | 384/243 |
| 3,478,509 | A * | 11/1969 | Fritz | 368/324 |
| 2006/0187767 | A1 * | 8/2006 | Conus et al. | 368/324 |
| 2006/0215499 | A1 * | 9/2006 | Kohler et al. | 368/324 |
| 2012/0113767 | A1 * | 5/2012 | Marechal et al. | 368/287 |

FOREIGN PATENT DOCUMENTS

| | | | |
|---|---|---|---|
| CH | 237 812 | A | 9/1945 |
| CH | 254 854 | A | 1/1949 |
| CH | 698 675 | B1 | 9/2009 |
| EP | 1 696 286 | A1 | 8/2006 |
| FR | 1 532 798 | A | 7/1968 |

* cited by examiner

*Primary Examiner* — Amy Cohen Johnson
*Assistant Examiner* — Matthew Powell
(74) *Attorney, Agent, or Firm* — Sughrue Mion, PLLC

(57) ABSTRACT

The timepiece movement includes a shock absorber bearing for a rotating wheel set, formed of an elastic device having a rigid central part and an elastic structure connected to said central part and extending at the periphery thereof, the central part having an aperture in which a pierced jewel is arranged and being materially connected to the timepiece movement via the elastic structure. This bearing further includes an endstone, which forms a top stop member for the pivot of the rotating wheel set and is assembled to said central part so as to move integrally therewith. This endstone extends at least partially above the elastic structure and is secured to the central part by a material connection between said central part and the bottom surface of the endstone.

15 Claims, 5 Drawing Sheets

SHOCK ABSORBER BEARING FOR A ROTATING WHEEL SET OF A TIMEPIECE MOVEMENT

This application claims priority from European Patent Application No. 10196103.5 the entire disclosure of which is incorporated herein by reference.

The present invention concerns a shock absorber bearing for a rotating wheel set of a timepiece movement. These bearings are devised to partially absorb the energy transmitted to the wheel set in the event of a shock, in particular when the timepiece movement is subject to a lateral shock.

BACKGROUND OF THE INVENTION

Various horological shock absorber bearings are known to those skilled in the art. FIGS. 1 and 2 show a standard type of bearing currently used in numerous timepiece movements. The bearing 2, called a "double inverted cone" bearing, is disclosed for example in FR Patent No 1 532 798. This bearing is arranged at the end of the arbour 6 of a rotating wheel set 4. More specifically, the pivot 8 of arbour 6 is mounted in the hole in a pierced jewel 10 forming bearing 2. Bearing 2 is formed of a support 12 with a central aperture in the bottom thereof for the passage of arbour 6 of the rotating wheel set. Support 12 has a recess inside which a setting 14 is arranged. This setting carries the pierced jewel 10 and an endstone 16 located above the pierced jewel. The setting and two jewels are held inside the recess of support 12 by a spring device 18, which, in the variant shown in FIGS. 1 and 2, includes two elastic tongues abutting against the top surface of the endstone. This standard type of bearing is considered attractive, particularly owing to the presence of a top endstone of relatively large diameter. Indeed, the endstone contributes to the attractive appearance of the timepiece movement and may be considered a decorative element of the timepiece movement. Those skilled in the art appreciate this conventional type of bearing shown in FIGS. 1 and 2.

FIGS. 3 and 4 show another shock absorber bearing disclosed in EP Patent No 1 696 286. According to this second known embodiment, this bearing essentially differs from the conventional type described above in that the pierced jewel 10 and endstone 16A are assembled to a rigid central part 28 of a flat elastic device 22, i.e. extending into a general plane. The two jewels are thus suspended at the centre of the elastic device, whose elastic structure or spring 26 is capable of undergoing axial and radial elastic deformation, i.e. in a general horizontal plane and also in the longitudinal direction of arbour 6 of the rotating wheel set. This second embodiment has certain advantages relative to the conventional shock absorber bearing described above, which are set out in EP Patent Application No. 1 696 286.

The elastic device 22 is formed by a peripheral ring 28 resting on an annular projecting portion provided in the bottom of the recess in base 12A. The elastic structure 26 is formed of several arms defining as many spring elements, which extend in an arc of a circle between peripheral ring 24 and the central part 28 of elastic device 22. This central part has a central aperture in which the pierced jewel 10 is arranged. Endstone 16A, placed on the top surface of this central part, is held in place by a cap 30, which has securing brackets 32 which extend along the lateral surface of the central part. The cap can be driven or bonded onto this central part.

It will be noted that the elastic structure 26 has a relatively complex geometry with a plurality of spring arms connecting peripheral ring 24 to the rigid central part 28. Thus, elastic device 22 is preferably made by a LIGA technique known to those skilled in the art.

As is clear from FIGS. 3 and 4, the shock absorber bearing 20 has a non conventional visual appearance. Indeed, the top view shows the entire flat elastic structure 26 and the endstone 16A is only visible through the small central aperture in the cap 30. Thus, the diameter of the visible surface of this top jewel 16A is substantially equal to that of the pierced jewel 10, which is small. By comparing the devices 2 and 20 respectively shown in FIGS. 1 and 3, the observer will note the significant difference in the visual appearance of the two devices. As set out above, the endstone of a shock absorber bearing in a mechanical timepiece movement is ornamental in nature and is used to add value to the mechanical movement. Although bearing 20 has several technical advantages and a variety of functions, it thus has the problem of a significant reduction in the visible diameter of endstone 16A.

FIG. 5 shows a shock absorber bearing 42 according to a third prior art embodiment, as disclosed, in particular in CH Patent No. 254 854. Bearing 42 overcomes the problem of reduced endstone diameter in bearing 20 of the second prior art embodiment described above. Bearing 42 includes an elastic device 22A of small thickness which extends in a generally horizontal plane. Although it has quite a different structure to the elastic structure 26 of FIGS. 3 and 4, the elastic structure of device 22A also allows elastic deformation in a horizontal plane and thus a horizontal movement of pierced jewel 10. This elastic structure would also allow axial deformation. However, the embodiment of FIG. 5 does not take advantage of this feature of elastic device 22A, unlike the bearing 20 described above. Indeed, endstone 16 does not move integrally with the pierced jewel and hence the central part of the elastic device. This jewel 16, which has a relatively large diameter, is placed on a ring or strut 46 on the peripheral part of device 22A. A second elastic device 48 is provided to hold jewel 16 in place and to allow it to move axially. This device 48 is formed of elastic tongues 50 abutting against the domed top surface of jewel 16. Since elastic tongues 50 are spaced apart, bearing 42 allows jewel 16 to be seen in a top view through a large aperture, so that the visual appearance of bearing 42 is similar to that of the conventional bearing 2 shown in FIGS. 1 and 2. However, to obtain this attractive effect, which enhances the timepiece movement, bearing 42 includes two distinct elastic devices 22A and 48. The first elastic device is associated with the pierced jewel 10 whereas the second elastic device is associated with the top endstone 16. Bearing 42 is thus relatively complex and expensive.

SUMMARY OF THE INVENTION

It is an object of the present invention to overcome the drawbacks of the prior art, and in particular to propose a shock absorber bearing which is efficient, inexpensive and has a conventional appearance with an endstone having a large diameter relative to that of the pierced jewel. In particular, the present invention proposes to achieve this object while maintaining the functional advantages provided by a bearing of the type described in FIGS. 3 and 4.

The present invention therefore concerns a timepiece movement provided with at least one shock absorber bearing for a rotating wheel set, wherein said shock absorber bearing includes an elastic device having a rigid central part and an elastic structure connected to said central part and extending at the periphery thereof, the central part has an aperture in which a pierced jewel is arranged and is materially connected to the timepiece movement by the elastic structure, so that the pierced jewel is suspendedly mounted by the elastic structure. The shock absorber bearing also includes an endstone which forms a top stop member for the pivot of the arbour of the rotating wheel set and is assembled to the central part of the elastic device to move integrally with said central part, the elastic structure being arranged to allow a radial/horizontal movement of the central part carrying the pierced jewel and also an axial movement of said central part, i.e. a movement along the geometric axis defined by the material arbour of the rotating wheel set mounted in the shock absorber bearing. The timepiece movement is characterized in that the endstone is at least partially above the elastic structure and in that it is fixed to the central part of the elastic device by a material connection between said central part and the bottom surface of the endstone.

Owing to the features of the invention, the bearing according to the invention includes a top endstone of relatively large diameter and overcomes the drawbacks of the prior art device shown in FIG. 5. Indeed, securing the endstone to the central part of the elastic device carrying the pierced jewel by a material connection formed between said central part and the bottom surface of the endstone does not lead to a reduction in the diameter of said endstone. This is a major advantage of the present invention and allows relatively simple and inexpensive embodiments.

According to a particular feature of the invention, there is a slot between the bottom surface of the endstone and the top surface of the elastic structure to allow the elastic structure to undergo a certain axial downward movement during absorption of an axial shock. Thus, although the endstone is secured to the central part of the elastic device extending into a generally horizontal plane, the endstone at least partially conceals the elastic structure while allowing said structure to be deformed in a horizontal plane perpendicular to the arbour of the rotating wheel set and also in an axial direction.

According to a preferred embodiment of the invention, the bottom surface of the endstone includes a first vertical surface and the central part of the elastic device includes a second vertical surface arranged opposite the first vertical surface. These particular features are important in the event that the timepiece is subject to radial shocks. The vertical surface of the central part forms a lateral stop member for the vertical surface of the endstone so that a lateral or radial shock does not cause any break in the material connection, particular of a weld or bond between the endstone and the central part of the elastic device. According to a preferred variant, the first and second vertical surfaces are cylindrical, which makes machining easy, particularly for the endstone. According to another particular variant, there is a slot between the first and second vertical surfaces filled with adhesive or a solder.

BRIEF DESCRIPTION OF THE DRAWINGS

Various embodiments and variants of the present invention will be described below in the following description, made with reference to the annexed drawings, given by way of non-limiting example, in which.

DETAILED DESCRIPTION OF THE INVENTION

Figure 1:
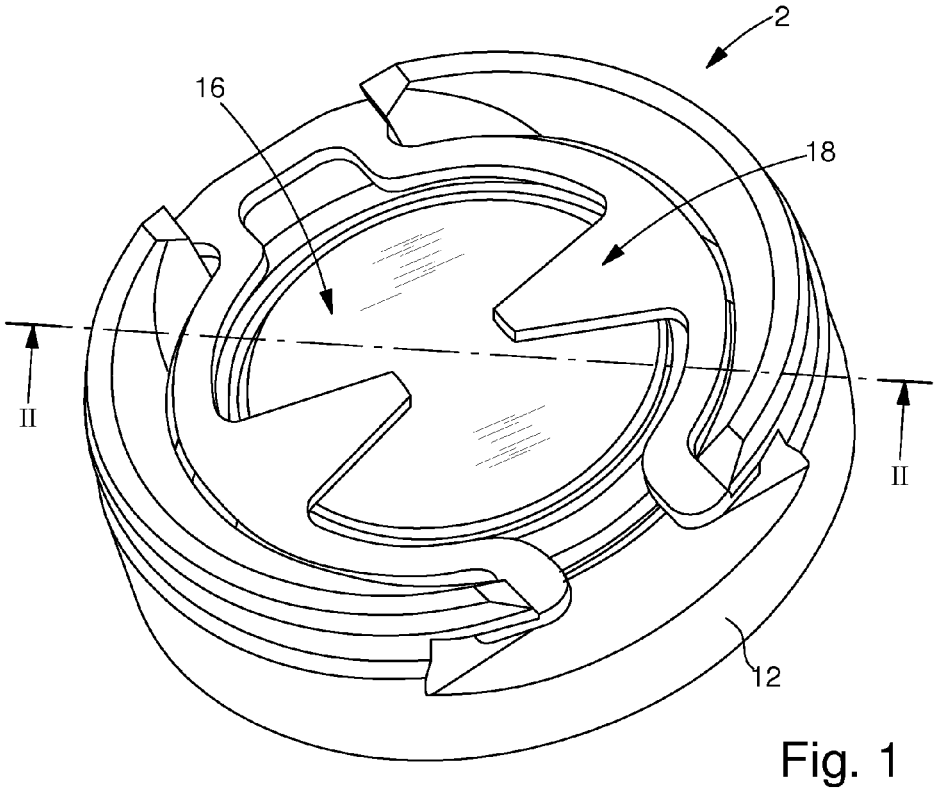
Fig. 1 (Prior Art)
FIG. 1, already described, is a perspective view of a first prior art bearing.
Figure 2:
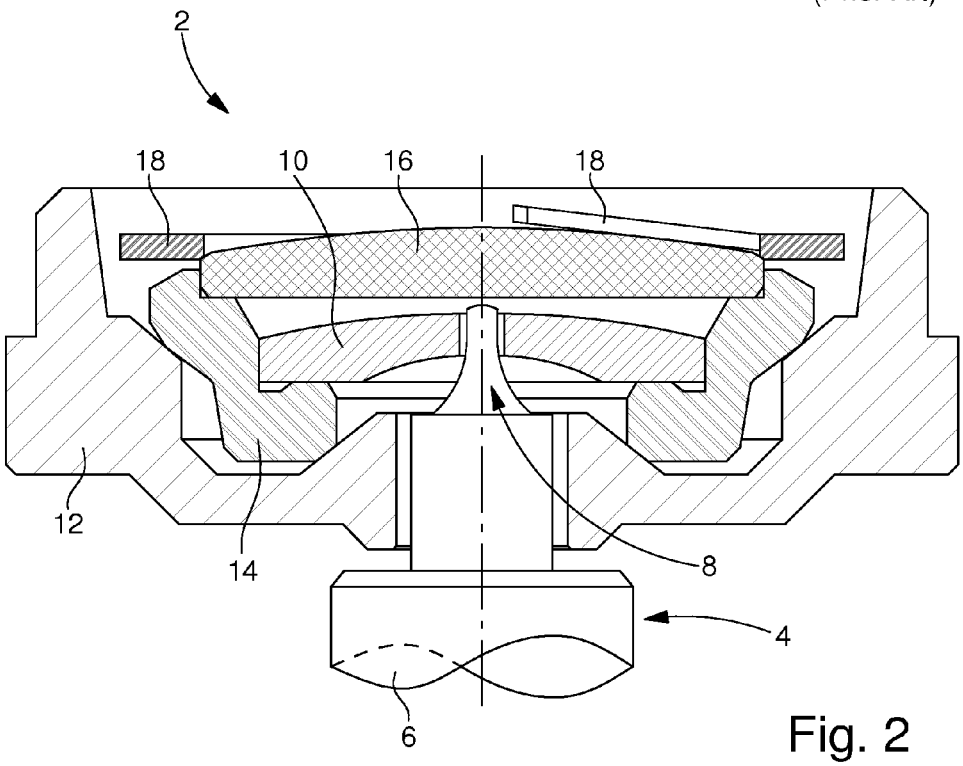
Fig. 2 (Prior Art)
FIG. 2 is a cross-section of FIG. 1 along the line II-II.
Figure 3:
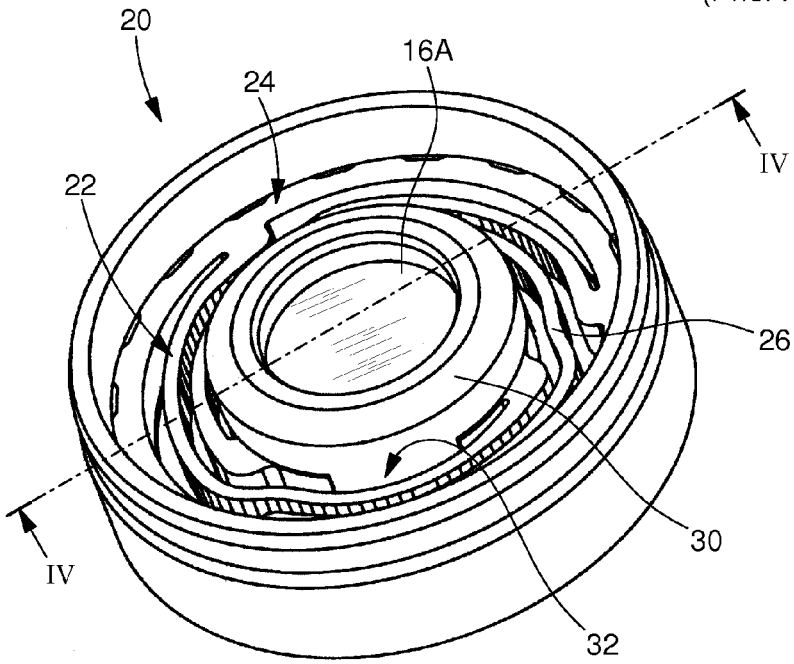
Fig. 3 (Prior Art)
FIG. 3, already described, is a perspective view of a second prior art bearing.
Figure 4:
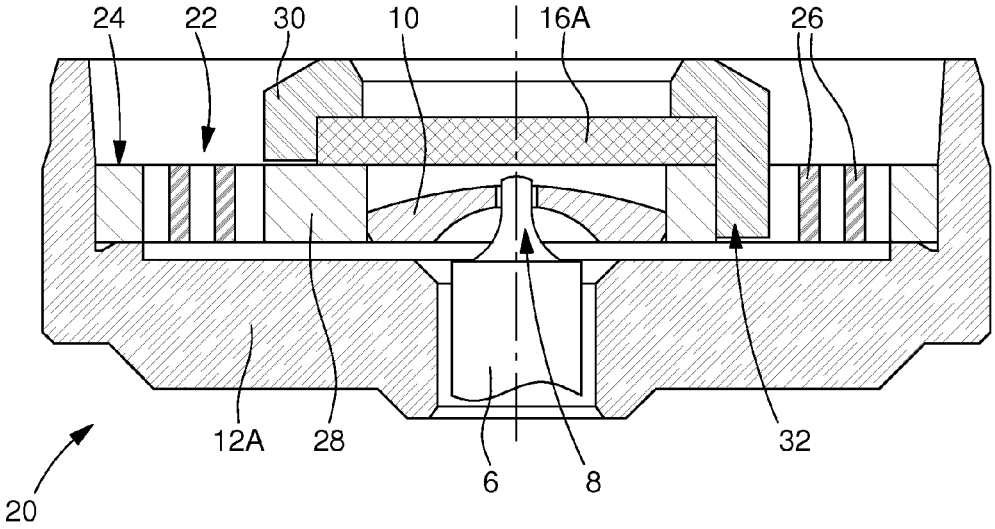
Fig. 4 (Prior Art)
FIG. 4 is a cross-section of FIG. 3 along the line IV-IV.
Figure 5:
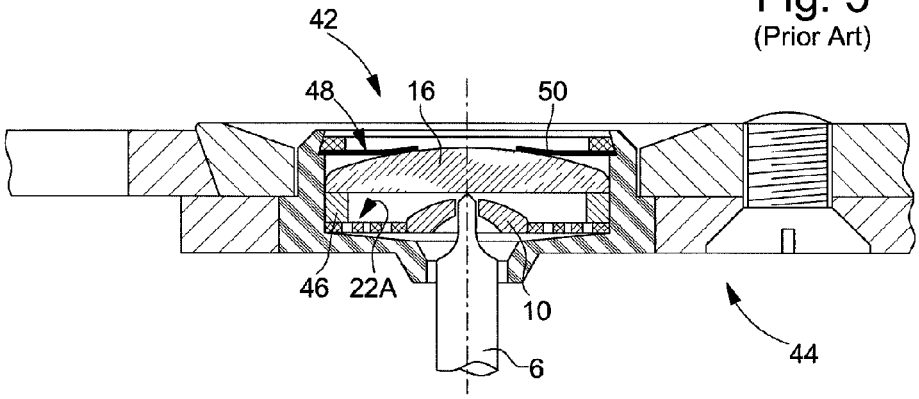
Fig. 5 (Prior Art)
FIG. 5, already described, shows a third embodiment of a prior art shock absorber bearing.
Figure 6:
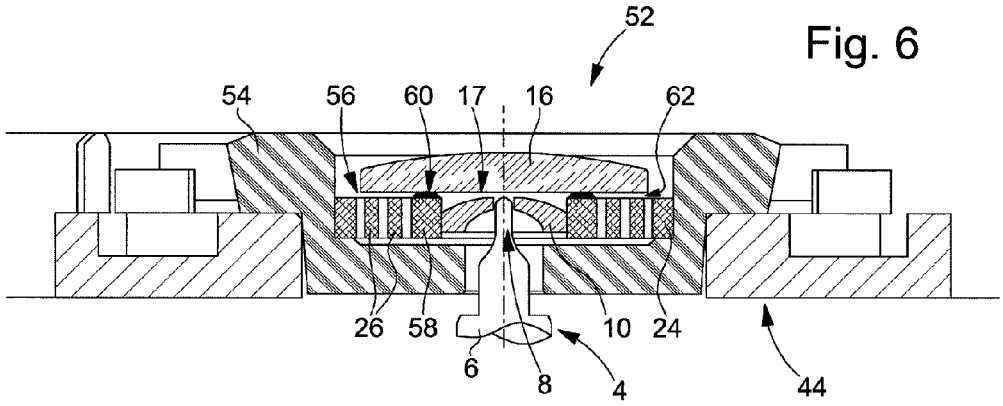
FIG. 6 is a cross-section of a first embodiment of a shock absorber bearing according to the present invention.

FIG. 6 shows a first embodiment of a timepiece movement 44 including a shock absorber bearing 52 for a rotating wheel set 4. Bearing 52 includes a pierced endstone 10 for receiving the pivot 8 of rotating wheel set 4. It further includes an elastic device 56 which has a rigid central part 58 and an elastic structure 26, connected to the central part and extending at the periphery thereof. The central part has an aperture in which pierced jewel 10 is arranged, said central part being therefore materially connected to the timepiece movement via elastic structure 26. Bearing 52 also includes an endstone 16 forming a top stop member for pivot 8. Elastic device 56 and jewels 10 and 16 are arranged inside a recess in a base or support-unit 54. Elastic device 56 further includes an annular peripheral part 24, which rests on an annular shoulder provided at the bottom of the recess in base 54. Elastic device 56 can be held in base 54 in various manners known to those skilled in the art. This device 56 can be driven into the recess in base 54 or bonded or welded thereto. The endstone is assembled to central part 58 so as to move integrally with said central part. Central part 58 thus acts as a support for pierced jewel 10 and also for the endstone, this assembly being suspended in bearing 52 by elastic structure 26.

According to the invention, endstone 16 extends at least partially above elastic structure 26 and it is secured to central part 58 by a material connection between said central part and the bottom surface 17 of said endstone. In the variant shown in FIG. 6, the material connection between endstone 16 and central part 58 is formed by an adhesive bond 60. Preferably, adhesive bond 60 has a certain thickness so as to define a slot 62 between the flat bottom surface 17 of endstone 16 and the flat top surface of the elastic structure 26. The width of slot 62 is preferably substantially equal to or slightly greater than the slot provided between elastic structure 26 and the bottom of the recess in base 54. This prevents the external edge of endstone 16 abutting against elastic device 56 in the event of an axial shock, which could cause endstone 16 to become detached and thus break the material connection between the endstone and the central part of the elastic device. Slot 62 thus enables the assembly formed by central part 58, pierced jewel 10 and endstone 16 to undergo a certain downward movement during absorption of an axial shock.

As shown in FIG. 6, endstone 16 has a large diameter relative to that of pierced jewel 10. Owing to the features of the invention, the diameter of the endstone may be only slightly smaller than the diameter of the recess provided in base 54. It is possible, in particular, for the endstone to be given a sufficiently large diameter to entirely cover elastic structure 26.

Figure 7:
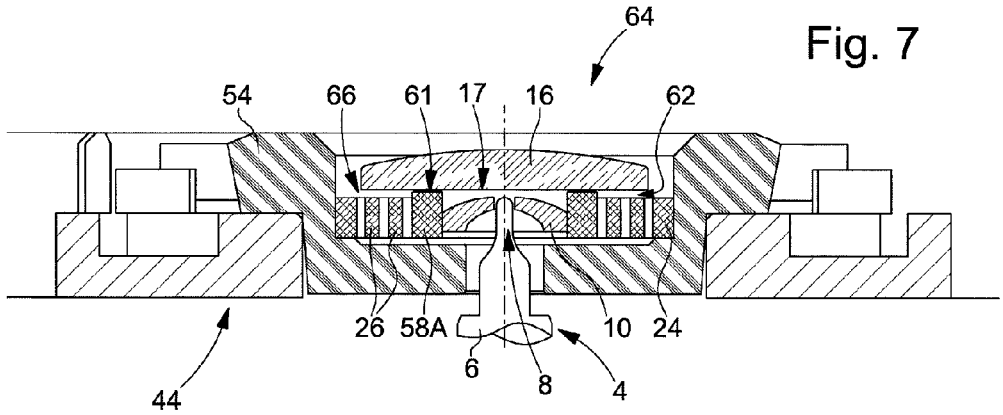
FIG. 7 is a cross-section of a variant of the first embodiment.

FIG. 7 shows a variant of the first embodiment described above. The references previously described will not be described again in detail here. The shock absorber bearing 64 differs from bearing 52 of FIG. 6 in that the elastic device 66 includes a rigid central part 58A the height of which is greater than that of elastic structure 26. Endstone 16 is secured to the central part 58A by a weld/solder 61. In order to guarantee that the weld is suitably reliable, the bottom surface 17 of the endstone includes an adhesion or primer layer deposited at least in the area provided for the weld, i.e. at least in the annular area located opposite the central part 58A. This adhesion layer is formed for example of chromium (Cr). A fine gold layer (Au) is preferably deposited on the adhesion layer. Then a solder is added, for example a gold-tin alloy. This solder can be plated either on endstone 16, on top of the adhesion layer and the gold layer, or on the top surface of central part 58A formed for example of nickel (Ni) or nickel-phosphorus (NiP). The application of heat required for welding may be performed in various manners by those skilled in the art. In particular, the welding may be carried out in a furnace. It will also be noted that an anti-diffusion layer, for example rhodium (Rh), is preferably deposited on the adhesion layer provided on the endstone and/or on the top surface of the central part.

Figure 8:
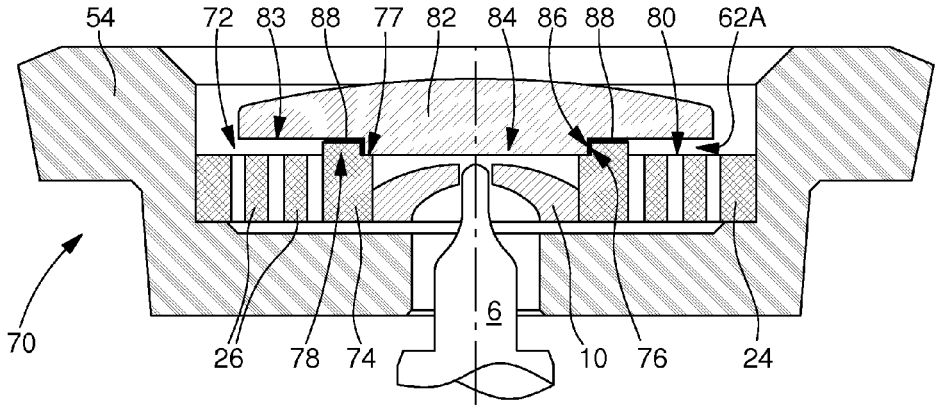
FIG. 8 is a cross-section of a second embodiment of the invention.

FIG. 8 shows a second preferred embodiment of the present invention. The shock absorber bearing 70 includes an elastic device 72 arranged in base 54. This elastic device 72 is similar to that of the first embodiment. It differs in the central part 74 thereof, the top surface of which has a recess defining a vertical cylindrical surface 76 and an annular shoulder 77. This shoulder 77 is substantially at the level of top surface 80 of elastic structure 26, so that central part 74 has a projecting top portion 78 relative to said top surface. The bottom surface 83 of endstone 82 also has recess defining a projecting bottom portion 84, the lateral surface 86 of which defines a cylindrical vertical surface located opposite vertical surface 76 of central part 74. The edge of portion 84 of endstone 82 is abutting against shoulder 77. A film of adhesive or solder can be provided between said shoulder and the endstone. The vertical surface 76 forms a lateral stop member for the bottom portion 84 of the endstone in the event of lateral shocks to the timepiece movement in which the bearing 70 is arranged. The complementary recesses in central part 74 and the endstone, on the one hand enable the endstone to be easily centered when it is assembled to the central part, and on the other hand prevent any shearing effect between the endstone and the central part when the movement is subject to lateral shocks, i.e. radial shocks to the rotating wheel set 4. This second embodiment provides a relatively large slot 62A between the bottom surface 83 of the endstone and top surface 80 of the elastic structure. The endstone is secured to central part 74 by means of an adhesive bond 88 or a weld. Preferably, there is a slot between cylindrical surfaces 76 and 86 filled with an adhesive 88 or a solder.

Figure 9:
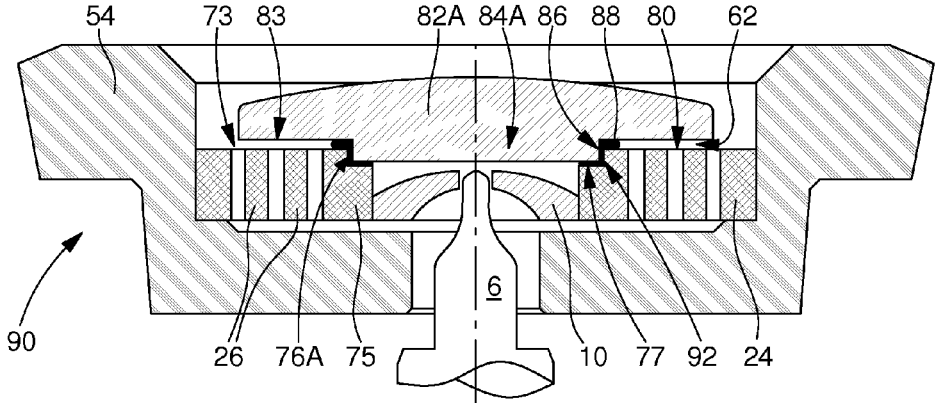
FIG. 9 shows a variant of the second embodiment.

FIG. 9 shows a variant of the second embodiment of the invention. The references previously described will not be described again in detail here. Bearing 90 essentially differs from that of FIG. 8 in that the vertical surface 76A of central part 75 of elastic device 73 is defined by the lateral surface of a recess 92 provided in central part 75. The bottom part 84A of endstone 82A is partially inserted into this recess 92. In this variant, the top surface of elastic device 73 is flat and has no projecting portions. In another variant, which is not shown, the two variants of FIGS. 8 and 9 are combined. Thus, the rigid central part of the elastic device has, on the one hand, a projecting top part, and on the other hand, a recess at the inner periphery of this projecting part. This means that the projecting top part 84A of the endstone has a larger thickness and, more specifically, the radial overlapping area of vertical surfaces 86 and 76+76A can be increased.

Figure 10:
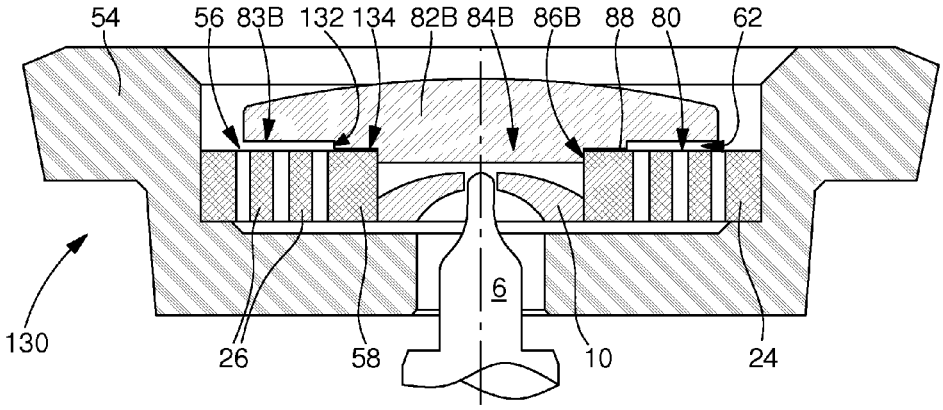
FIG. 10 shows another preferred variant of the second embodiment of the invention.

FIG. 10 shows a preferred variant which differs from the preceding variants in that the elastic device 56 has a flat top surface 80 on a single level and that endstone 82B has a projecting bottom portion 84B, the diameter of which substantially matches that of the pierced jewel. This part 84B is inserted into the aperture passing through central part 58 and the cylindrical vertical surface 86B thereof is thus arranged opposite the top of the wall of this through aperture. The bottom face 83B of the endstone has a first recess defining, on the one hand, the bottom part 84B and on the other hand, a circular step 134 which is bonded or welded to top surface 80 of central part 58. In the case of the bearing 130 shown in FIG. 10, this bottom surface 83B has a second recess 132 in order to provide a sufficiently high slot 62 between the elastic structure and the endstone. In another variant which is not shown, as in the example of FIG. 6, a sufficiently thick layer of adhesive or solder/braze is provided to obtain the desired slot without additional machining of the endstone. Thus, as in the examples of FIGS. 8 and 9, the bottom surface of the endstone is only on two horizontal levels, but with a projecting bottom portion which is inserted into the aperture of the elastic device in which the pierced jewel is arranged.

It will be noted that the space between the pierced jewel and the endstone defines a small chamber for lubricating oil, which remains in the centre by a capillary effect. To allow the oil to be introduced into the hole in the pierced jewel, recesses are provided in the wall of the hole through the central part of the elastic device. Thus, the air comprised in the chamber can be evacuated through these recesses at the periphery of the pierced jewel when oil is introduced into the hole in the jewel. These lateral recesses also enable the oil chamber to be cleaned, allowing it to be rinsed. Finally, as mentioned in EP Patent Application No. 1 696 286 where these recesses are shown in FIG. 7, the lateral recesses provide a certain elasticity, allowing the pierced jewel to be driven into the rigid central part of the elastic device.

Figure 11:
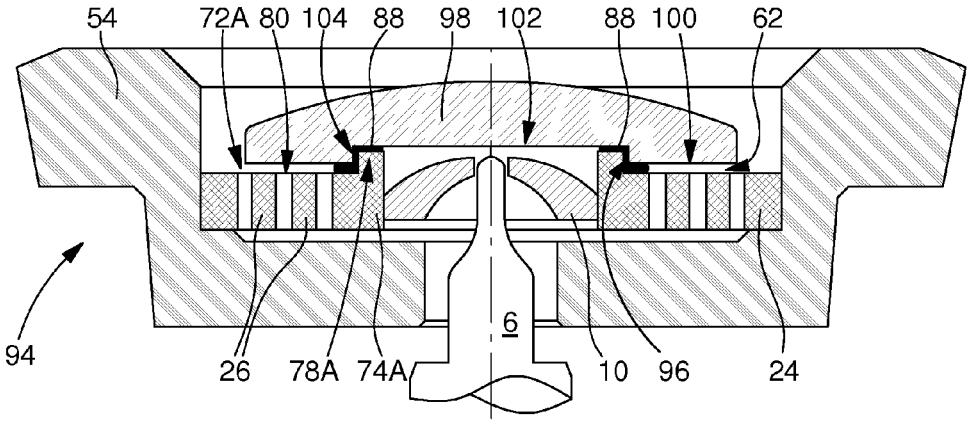
FIG. 11 is a cross-section of a third embodiment of the invention.

FIG. 11 shows a third embodiment of the invention. Elastic device 72A differs from elastic device 72 of FIG. 8 in that the projecting top portion 78A is located in an internal area of central part 74A. This projecting portion has a vertical lateral surface 96 forming a cylindrical surface. The bottom surface 100 of endstone 98 has a recess 102 whose lateral wall 104 defines a cylindrical vertical surface opposite the cylindrical surface 96 of central part 74A. This vertical surface 96 acts as a lateral stop member for top jewel 98. The shock absorber bearing 94 has the same advantages as the shock absorber bearings 70 and 90 described above. This bearing 94 has an additional advantage in that the machining performed in the bottom face 100 of endstone 98 is performed in a central area therein. This allows the endstone to have a domed top surface with a smaller radius of curvature to that of jewels 82 or 82A of the second embodiment described above. This third embodiment also allows the height of slot 62 to be precisely defined while increasing the space available for pierced jewel 10, so that the height of the elastic structure 26 can be lower than in the preceding embodiment.

Figure 12:
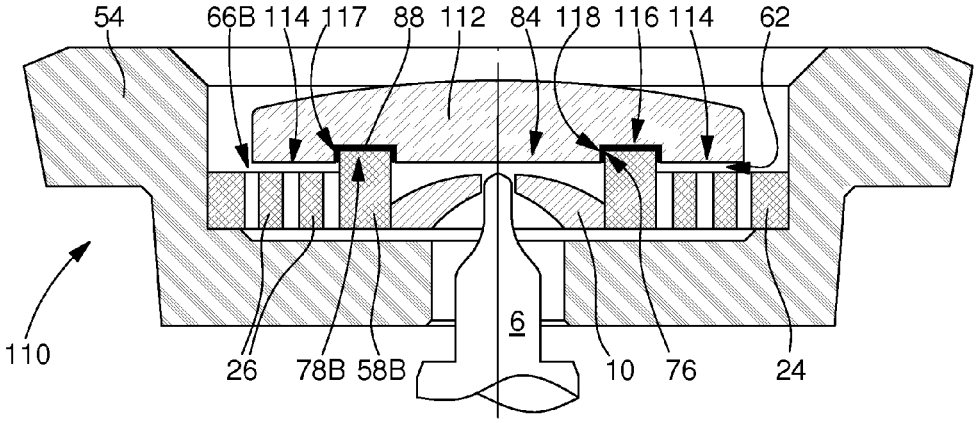
FIG. 12 is a variant of the third embodiment of the invention.

A variant of the third embodiment is shown in FIG. 12. Bearing 110 differs from bearing 94 of FIG. 11 in that the central part 58B of elastic device 66B includes an annular top portion 78B, the width of which substantially matches that of central part 58B. Moreover, this variant differs from the preceding one in that the endstone 112 has a groove 116 machined into its bottom surface 114. In a first variant, groove 116 is annular and has a slightly larger width than that of top portion 78B. The latter is partially inserted into groove 116 of jewel 112, which is secured to this top portion by an adhesive 88 or by a solder/braze. According to a second variant, the widths of groove 116 and annular portion 78B are adjusted to allow the annular portion to be driven into the groove of jewel 112. One advantage of bearing 110 results from the fact that the bottom surface of the endstone is flat, with the exception of groove 116, so that this bottom surface can easily be polished in the area superposed on the pivot of the rotating wheel set.

Groove 116 has an external lateral surface 117 and an internal lateral surface 118. These two lateral surfaces 117 and 118 define cylindrical vertical surfaces which are respectively arranged opposite the two corresponding vertical surfaces of the top portion 78B of the central part of the elastic device.

Figure 13:
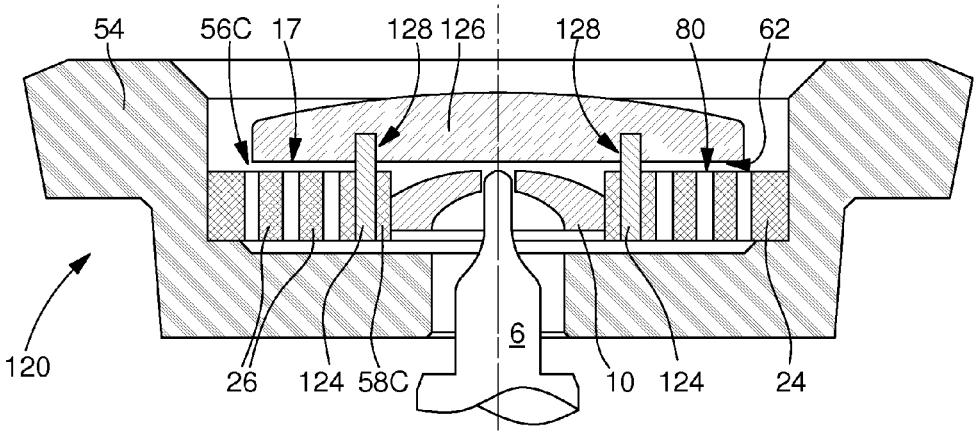
FIG. 13 is a cross-section of a fourth embodiment of the invention.

Finally, a fourth embodiment of the invention is shown in FIG. 13. This fourth embodiment differs from the other embodiments mainly in the nature of the material connection provided between endstone 126 and the rigid central part 58C of elastic device 56C. Bearing 120 includes pins 124 which are, on the one hand, arranged in holes provided in central part 58C and, on the other hand, in matching holes 128 machined into the top jewel 126. Pins 124 can be pressed, welded or bonded in central part 58C and also pressed or bonded in the holes provided in endstone 126. In the case of bonding, the holes machined into the top jewel 126 have a slightly larger diameter than that of pins 124. It will be noted that two pins may suffice but three pins will preferably be provided. The method of securing these pins to top jewel 126 by bonding has an industrial advantage given the machining tolerances. Thus, if the holes have a slightly larger diameter than that of the pins, the pins will enter the corresponding holes in the endstone more easily and the adhesive will fill the remaining space.

Other variants and in particular other means for forming a material connection between the endstone and the central part of the elastic device may be devised by those skilled in the art without departing from the scope of the present invention.

What is claimed is:

1. A timepiece movement including a shock absorber bearing for a rotating wheel set, wherein said shock absorber bearing comprises:

a pierced jewel for receiving a pivot of the rotating wheel set;

an elastic device having a rigid central part and an elastic structure connected to said central part and extending at a periphery thereof, the central part having an aperture in which the pierced jewel is arranged and being materially connected to the timepiece movement via the elastic structure;

an endstone forming a top stop member for said pivot and assembled to said central part so as to move integrally with said central part;

wherein the endstone extends at least partially above said elastic structure and is secured to said central part by a material connection between said central part and the bottom surface of the endstone.

2. The timepiece according to claim 1, wherein there is a slot between the bottom surface of the endstone and the top surface of the elastic structure to allow said elastic structure to undergo a certain axial downward movement during absorption of an axial shock.

3. The timepiece movement according to claim 1, wherein said bottom surface of the endstone has a first vertical surface and said central part of the elastic device has a second vertical surface arranged opposite the first vertical surface.

4. The timepiece movement according to claim 3, wherein said first and second vertical surfaces are cylindrical.

5. The timepiece movement according to claim 4, wherein there is a slot filled with adhesive or a solder between said first and second vertical cylindrical surfaces.

6. The timepiece movement according to claim 4, wherein said first vertical surface is defined by the external lateral surface of a projecting bottom portion of the endstone.

7. The timepiece movement according to claim 6, wherein said second vertical surface is defined by the lateral surface of a recess provided in said central part of the elastic device.

8. The timepiece movement according to claim 6, wherein the diameter of said projecting bottom portion is substantially equal to that of the pierced jewel, said bottom portion of the endstone being inserted into said aperture in said central part of the elastic device.

9. The timepiece movement according to claim 4, wherein said first vertical surface is defined by the lateral surface of a recess formed in the bottom surface of the endstone.

10. The timepiece movement according to claim 4, wherein said first vertical surface is defined by one of the two lateral surfaces of a groove made in the bottom surface of the endstone.

11. The timepiece movement according to claim 4, wherein said second vertical surface is defined by a projecting top portion of said central part of the elastic device.

12. The timepiece movement according to claim 1, wherein said endstone is secured to the central part of the elastic device by an adhesive bond.

13. The timepiece movement according to claim 1, wherein said endstone is secured to the central part of the elastic device by welding.

14. The timepiece movement according to claim 13, wherein an adhesion layer is deposited on the bottom surface of the endstone at least in the welding area.

15. The timepiece according to claim 1, wherein said endstone is secured to the central part of the elastic device by pins inserted, on one hand, into holes machined into the bottom surface of the endstone and on the other hand into holes provided in the top surface of the central part of the elastic device.

* * * * *